US007575236B1

(12) United States Patent
Haber

(10) Patent No.: US 7,575,236 B1
(45) Date of Patent: Aug. 18, 2009

(54) WAGERING CARD GAME

(76) Inventor: Jose Cherem Haber, Paseo de las Palmas 1260, Mexico D.F. (MX) 11000

( * ) Notice: Subject to any disclaimer, the term of this patent is extended or adjusted under 35 U.S.C. 154(b) by 247 days.

(21) Appl. No.: 11/355,405

(22) Filed: Feb. 16, 2006

(51) Int. Cl.
*A63F 1/00* (2006.01)

(52) U.S. Cl. ..... 273/292; 273/274; 463/12

(58) Field of Classification Search ..... 273/292, 273/274, 309; 463/12, 13
See application file for complete search history.

(56) References Cited

U.S. PATENT DOCUMENTS 5,362,064 A * 11/1994 Lofink et al. ..... 273/292
6,299,171 B1 * 10/2001 Mollo et al. ..... 273/292

* cited by examiner

*Primary Examiner*—Benjamin H Layno
(74) *Attorney, Agent, or Firm*—Greenberg Traurig

(57) ABSTRACT

A method of conducting a wagering game is disclosed. Players may place wagers on a designated player's hand or a banker's/dealer's hand. Once wagers are placed, the designated player and a banker/dealer are each dealt two cards. A point value is established for the two cards based on a scoring system wherein aces count as one point, tens and face cards count as zero points and twos through nine count as their face value. The point values of the player's hand and the banker's/dealer's hand are then compared to determine a winner based on which hand is nearest to nine. For two digit hand values, only the one's digit is used. Winning wagers are paid at 1 to 1 odds. Should a tie outcome occur, all players pay a commission on their wagers whether on the player's hand or the banker's/dealer's hand. In an alternative version, each player plays individually against a banker/dealer.

13 Claims, 4 Drawing Sheets

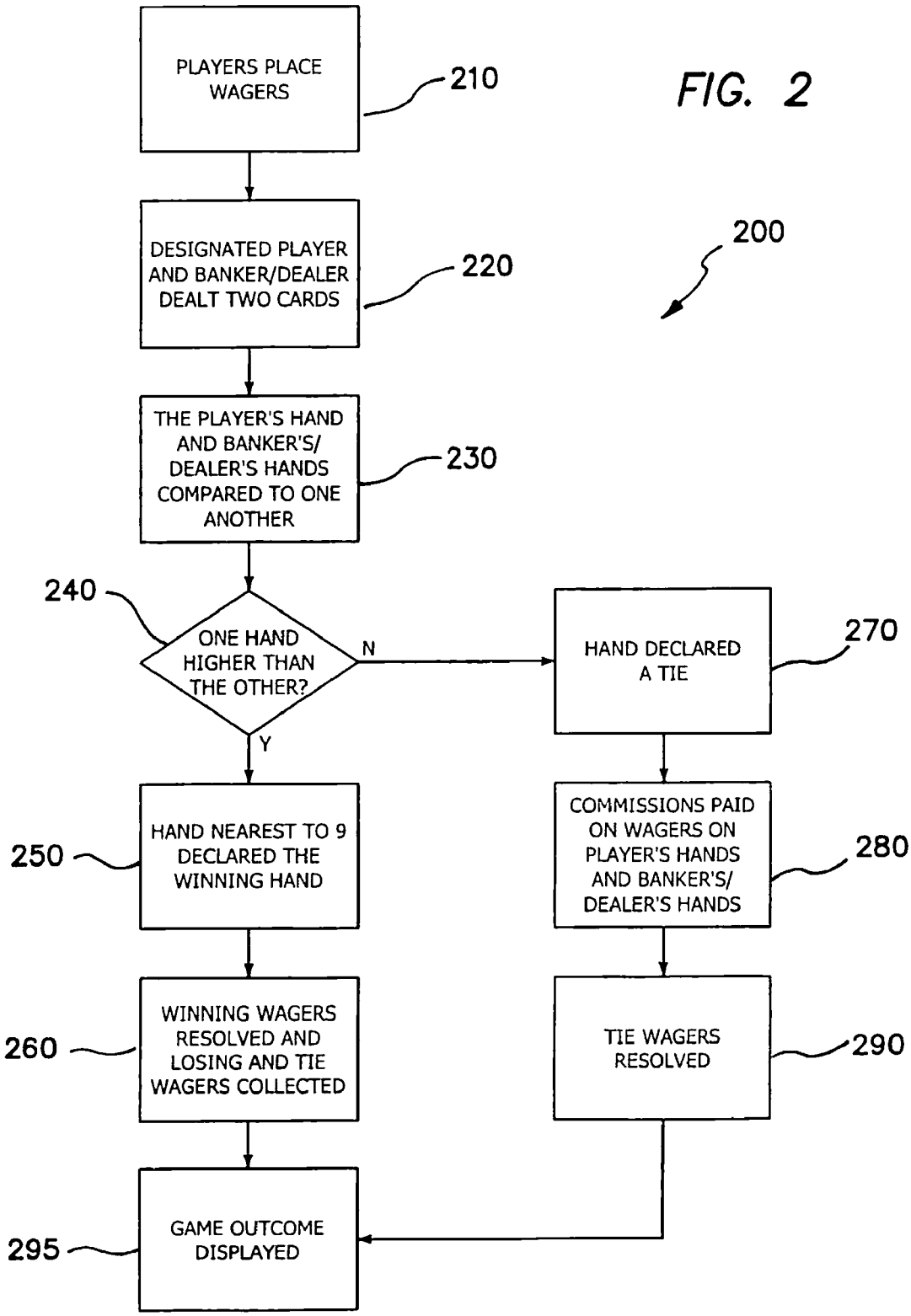
PLAYERS PLACE WAGERS
210
FIG. 2
200
DESIGNATED PLAYER AND BANKER/DEALER DEALT TWO CARDS
220
THE PLAYER'S HAND AND BANKER'S/ DEALER'S HANDS COMPARED TO ONE ANOTHER
230
240
ONE HAND HIGHER THAN THE OTHER?
N
HAND DECLARED A TIE
270
Y
HAND NEAREST TO 9 DECLARED THE WINNING HAND
250
COMMISSIONS PAID ON WAGERS ON PLAYER'S HANDS AND BANKER'S/ DEALER'S HANDS
280
WINNING WAGERS RESOLVED AND LOSING AND TIE WAGERS COLLECTED
260
TIE WAGERS RESOLVED
290
GAME OUTCOME DISPLAYED
295

WAGERING CARD GAME

FIELD OF THE INVENTION

The present invention relates to a wagering game utilizing playing cards. More particularly, the embodiments relate to a card game involving a comparison of hand totals.

BACKGROUND

Legalized gaming is flourishing in the United States and worldwide. Accordingly, casinos are in constant need of new games of chance to retain and attract patrons. The existing games of chance, such as blackjack, Caribbean Stud Poker, Baccarat, Roulette Casino War, Pai Gow and Craps remain popular but players need new games of chance to maintain their interest. Moreover, the existing games of chance suffer from drawbacks.

For example, Baccarat includes complicated rules and a commission on winning wagers, Casino War is a non-exciting game having a large house edge and Caribbean Stud is a slow game having a large house edge.

Thus, there continues to a need for a new game of chance that is easy to learn and play, involves an acceptable house edge and does not incorporate commissions on winning wagers.

SUMMARY

Accordingly, a first embodiment of the present invention is a method of conducting a wagering game comprising: accepting wagers on a designated player's hand or a banker's/dealer's hand; providing two or more cards to the designated player and the banker/dealer such that the designated player and the banker/dealer receive the same number of cards; comparing a value of the designated player's hand to a value of the banker's/dealer's hand wherein said value of the designated player's hand and the banker's/dealer's hand is in a range of zero to nine points based on a pre-established scoring system wherein aces count as one point, tens and face cards count as zero points and all other cards count as their face value and wherein a two-digit hand total is deemed to have a value corresponding to the one's digit of the two-digit total; resolving the wagers based on whether the designated player's hand or the banker's/dealer's hand is nearest to a value of nine; and in response to a tie between the designated player's hand and the banker's/dealer's hand, requiring all players to pay a commission on their wagers whether on the designated player's hand or the banker's/dealer's hand.

In one practical live embodiment, players may place wagers on a player's hand or a banker's/dealer's hand and/or a tie outcome, akin to a Baccarat game. Thereafter, the player and the banker/dealer are each dealt two cards. The winning hand is the two-card hand having a total value nearest to nine. Should the player's hand and banker's/dealer's hand result in a tie, any tie wagers are paid and wagers on the player's hand and the banker's/dealer's hand require the payment of a commission. Accordingly, the commission is paid on tie hands, not on winning wagers.

Other variations, embodiments and features of the present invention will become evident from the following detailed description, drawings and claims.

BRIEF DESCRIPTION OF THE DRAWINGS

FIG. 2 shows a flow chart detailing play of the first embodiment of the present invention;

DETAILED DESCRIPTION

Figure 1:
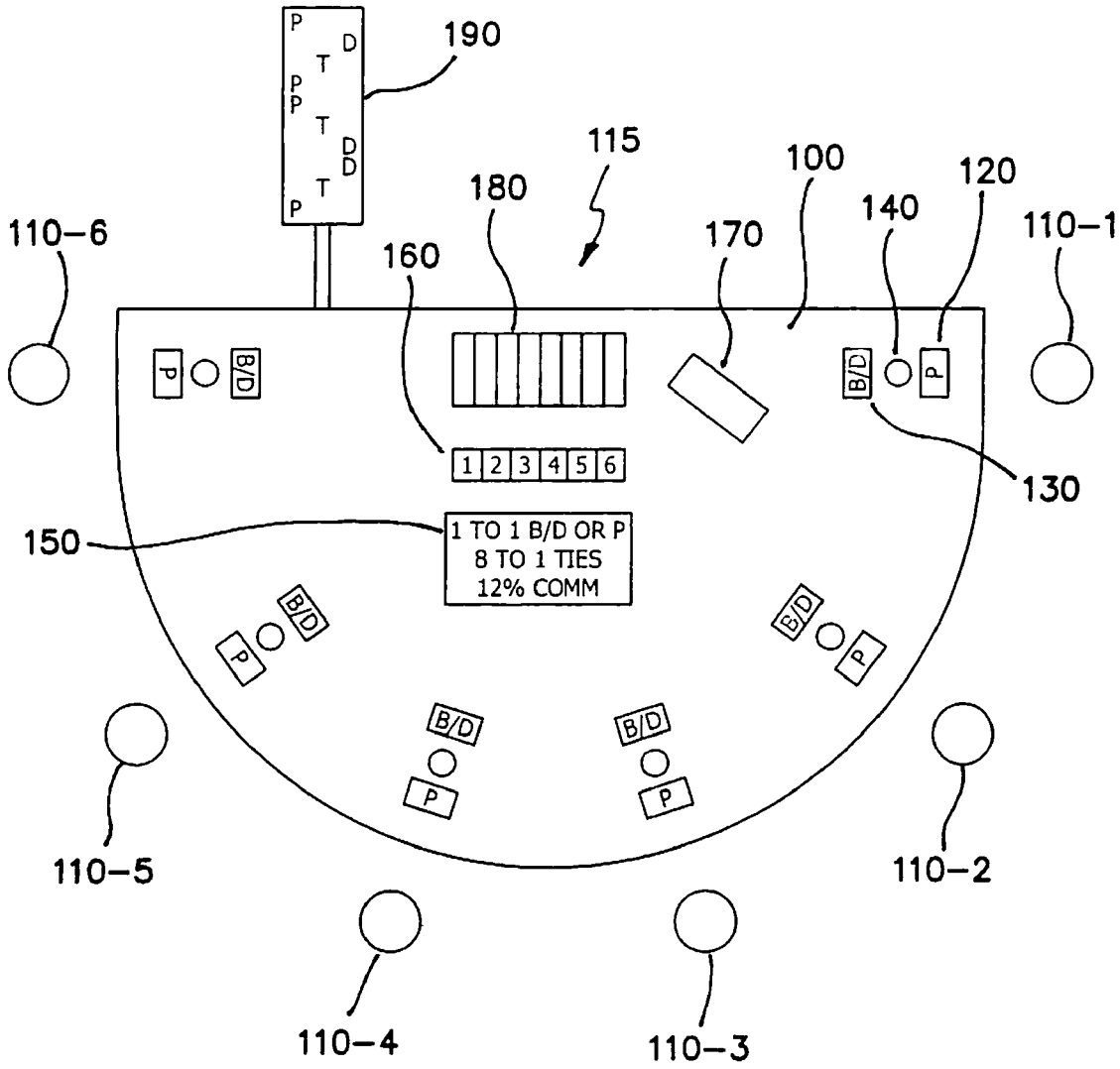
FIG. 1 shows a top view of a gaming table top of one embodiment of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Reference is now made to the figures wherein like parts are referred to by like numerals throughout. FIG. 1 illustrates one embodiment of a gaming table top of the present invention generally referred to by reference numeral 100. The gaming table top 100 comprises six player positions 110-1 through 110-6 and a dealer position 115. Each player position 110-1 through 110-6 includes a player wager area 120, banker/dealer wager area 130, tie wager area 140 and optionally a payout listing 150. As shown the payout listing 150 depicts a 1 to 1 payout on winning wagers on player's hands and dealer's hands, 8 to 1 on winning tie wagers and a 12% commission on wagers on player's hands and dealer's hands in response to a tie outcome. A commission chart 160 allows a dealer to track commissions owed by each player during a round of play through a card shoe 170. The table also supports a chip tray 180 and game display 190.

A flow chart 200 shown in FIG. 2 details a method of play according to a first embodiment of the present invention. A game begins with each player wagering on a designated player's hand or banker's/dealer's hand 210 by placing a wager in the player wager area 120 or banker/dealer wager area 130, respectively. The players may also place a wager on a tie outcome by placing a wager in the tie wager area 140. The dealer (or a player or banker) then deals a designated player two cards and the dealer two cards 220 by dealing a first card from the card shoe 170 to the player, a second card to the dealer, a third card to the player and a fourth card to the dealer. Alternative deal arrangements may be used as well. One to eight decks may be used to facilitate the embodiments of the present invention. The two-card, player's hand and banker's/dealer's hand are then compared to one another 230. The comparison is based on a single digit value of each hand between 0 and 9. A scoring system counts aces as one point, tens and face cards as zero points and twos through nines as their face value. Any two digit score is equated to the ones digit in the two digit number. For example, a two-card total of 15 results in a value of 5 and a two-card total of 18 results in a value of 8. Next, it is determined if one hand has a higher value than the other 240 (i.e., no tie outcome). If so, the hand having a value nearest to 9 is considered the winning hand 250 and corresponding winning wagers are resolved 260 at 1 to 1 or even money and losing and tie wagers are collected. If not, the game results in a tie 270. Based on the tie outcome, all players placing a wager on the player's hand or the dealer's hand pay a commission on their wager 280. The commission may take many forms, but 10% to 12% of the wager on the player's hand and dealer's hand is preferred. At step 290, wagers on the tie outcome are paid at 8 to 1 odds. The game outcomes (i.e., winning player's hand, winning dealer's hand or a tie) are displayed 295 on the game display 180. The game display shows ten or more preceding game outcomes thereby allowing players to analyze the data for subsequent wagers. Commissions may also be tracked and paid in total at the end of a card shoe. In one embodiment, the shoe is passed after a tie outcome.

Figure 3:
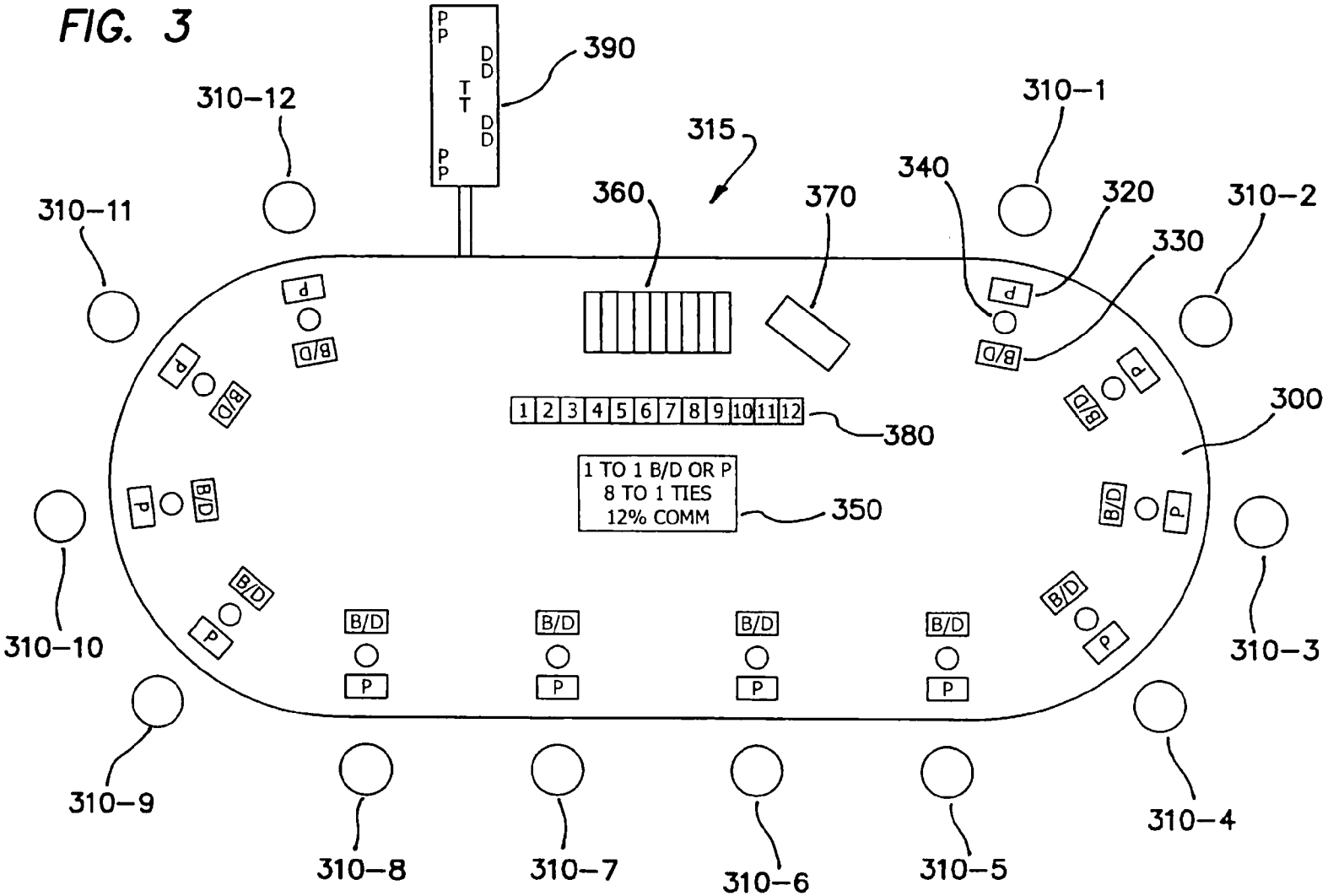
FIG. 3 shows a top view of an alternative gaming table top of one embodiment of the present invention.

Now referring to FIG. 3, a larger gaming table top 300 includes twelve player positions 310-1 through 310-12. Each player position 310-1 through 310-12 and a dealer position 315. Each player position 310-1 through 310-12 includes a player wager area 320, banker/dealer wager area 330, tie wager area 340 and optionally a payout listing 350. The table also supports a chip tray 360, card shoe 370, commission chart 380 and game display 390. Other than accommodating twelve players, the larger gaming table top 300 facilitates the same games as the smaller six player gaming table top 100.

In a banker embodiment, a player is designated as a banker such that the game is played like Baccarat. Designating a player as a banker may be accomplished using a high wager, high card, dice or other suitable means. In an alternative game embodiment each player plays against the banker/dealer. In such an embodiment, each player and the banker/dealer receive two cards and the comparison of hand values is conducted individually for each player's hand against the banker's/dealer's hand. Other game embodiments may utilize more than two cards per hand while continuing to maintain hand values between 0 and 9. This is possible given the scoring system wherein only the one's digit is considered in the hand's final point value.

Figure 4:
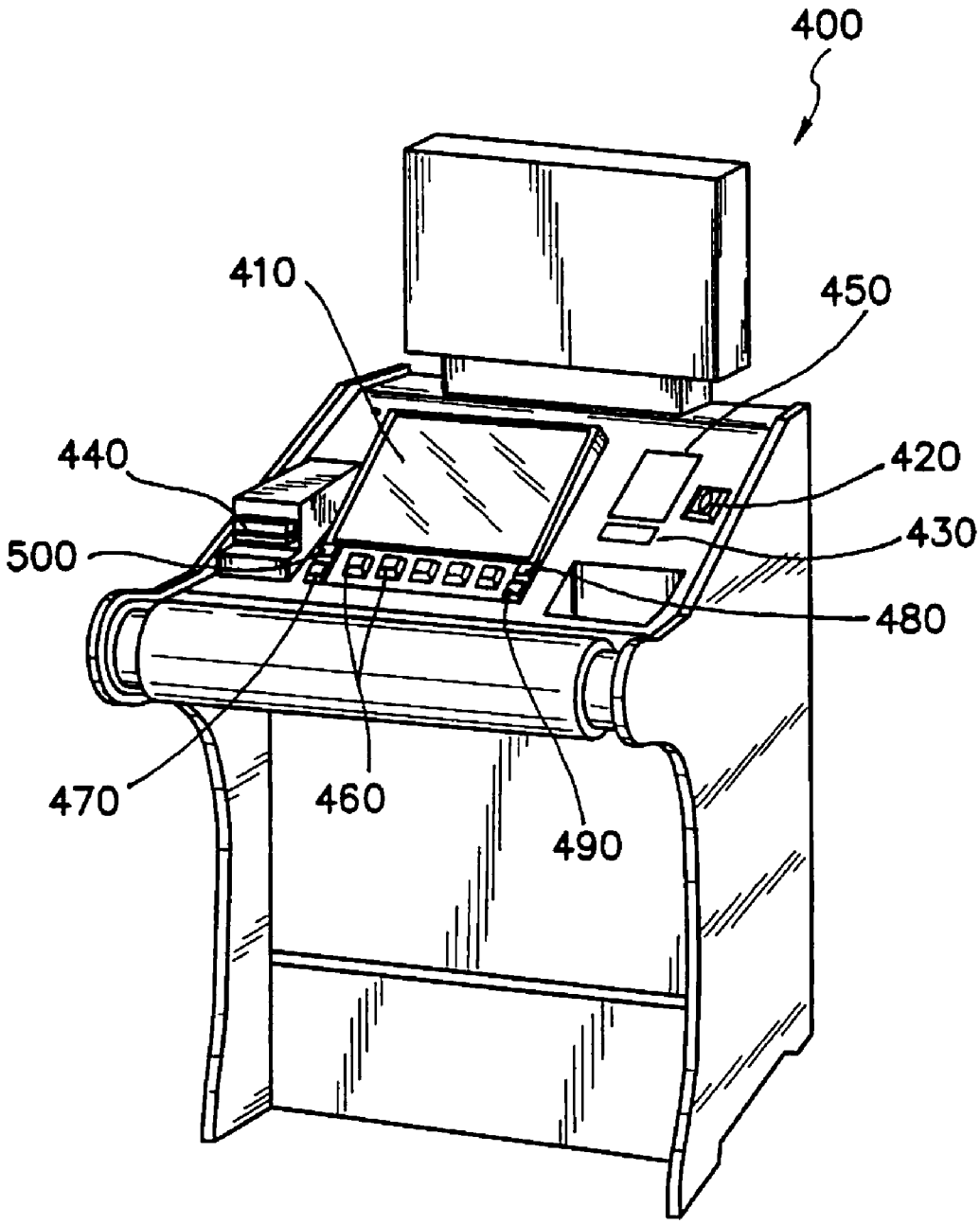
FIG. 4 shows an electronic gaming device for facilitating the embodiments of the present invention.

FIG. 4 shows an electronic gaming device 400 of the type that may facilitate the embodiments of the present invention. The device 400 includes a display 410, coin input 420, bill and/or coupon validator 430, player card reader 440, credit display 450, game operation buttons 460, bet one unit button 470, bet max units button 480, deal button 490 and cash out button 500. Alternatively or additionally, the functions of buttons 460-500 may also be facilitated by touch screen technology.

The operation of electronic gaming devices (e.g., slot machines and video poker machines) is controlled by microprocessors which communicate with internal memory devices and the external features of the devices. The microprocessors also incorporate, or communicate with, a random number generator which ensures the randomness of the device's outcomes. In the embodiments of the present invention, one or more processors, along with memory and related devices, control the new applications disclosed herein. Therefore, the embodiments of the present invention, along with the corresponding odds, may be programmed into the processor or associated software. Since the technology for operating and controlling electronic gaming devices is well known to those skilled in the art, the subtle details are not described herein.

With the electronic gaming device 400, a player either places a wager on the player's hand or the dealer's hand, and/or the tie outcome. Payouts for winning wagers and commissions are handled by the electronic gaming device processor.

A global computer network (e.g., the Internet) may also facilitate play of the embodiments of the present invention.

Although the invention has been described in detail with reference to several embodiments, additional variations and modifications exist within the scope and spirit of the invention as described and defined in the following claims.

I claim:

1. A method of conducting a wagering game comprising:

providing one or more decks of cards;

accepting wagers from each participating player on only one of two hands, a designated player's hand or a banker's/dealer's hand;

dealing only two hands by providing two or more cards to the designated player and the banker/dealer such that the designated player and the banker/dealer receive the same number of cards;

comparing a value of the designated player's hand to a value of the banker's/dealer's hand wherein said value of the designated player's hand and the banker's/dealer's hand is in a range of zero to nine points based on a pre-established scoring system wherein aces count as one point, tens and face cards count as zero points and all other cards count as their face value and wherein a two-digit hand total is deemed to have a value corresponding to the one's digit of the two-digit total;

resolving the wagers based on whether the designated player's hand or the banker's/dealer's hand is nearest to a value of nine; and responsive to a tie between the designated player's hand and the banker's/dealer's hand, requiring all players to pay a commission based on wager amounts on the designated player's hand or the banker's/dealer's hand.

2. The method of claim 1 further comprising designating a player as the banker.

3. The method of claim 1 further comprising providing exactly two cards to the designated player and the banker/dealer.

4. The method of claim 1 further comprising providing the two or more cards from one to eight decks of cards.

5. The method of claim 1 further comprising resolving winning wagers on the designated player's hand or banker's/dealer's hand at 1 to 1 odds.

6. The method of claim 1 further comprising establishing the commission in a range of 10%-12% of the wager placed on the designated player's hand or banker's/dealer's hand.

7. The method of claim 1 further comprising accepting wagers on a tie outcome and resolving said tie wagers at 8 to 1 odds.

8. The method of claim 1 wherein the method is facilitated by an electronic gaming device or computer network.

9. A method of conducting a wagering game comprising:

providing one or more decks of cards;

accepting wagers for each participating player on only one of two hands, a designated player's hand or banker's/dealer's hand;

dealing only two hands by providing two cards to the designated player and the banker/dealer;

comparing a value of the designated players hand to a value of the banker's/dealer's hand wherein said value of the designated player's hand and the banker's/dealer's hand is in a range of zero to nine points based on a pre-established scoring system wherein aces count as one point, tens and face cards count as zero points and all other cards count as their face value and wherein a two-digit hand total is deemed to have a value corresponding to the one's digit of the two-digit total;

resolving the wagers based on whether the designated player's hand or the banker's/dealer's hand is nearest to a value of nine; and responsive to a tie between the designated player's hand and the banker's/dealer's hand, requiring all players to pay a commission based on wager amounts on the designated player's hand or the banker's/dealer's hand.

10. The method of claim 9 further comprising designating a player as the banker.

11. The method of claim 9 further comprising resolving winning wagers on the designated player's hand or banker's/dealer's hand at 1 to 1 odds and winning tie wagers at 8 to 1 odds.

12. The method of claim 9 further comprising establishing the commission in a range of 10%-12% of the wager placed on the designated player's hand and banker's/dealer's hand.

13. The method of claim 9 wherein the method is facilitated by an electronic gaming device or computer network.

* * * * *